US005944558A

United States Patent [19]

Iwahori

[11] Patent Number: 5,944,558

[45] Date of Patent: Aug. 31, 1999

[54] CONNECTOR WITH PROJECTED RIB TO GUIDE THE HOLDER AND THE JIG TO CONTROL THE CONNECTIVITY OF THE TERMINAL

[75] Inventor: Yoshihiro Iwahori, Shizuoka-ken, Japan

[73] Assignee: Yazaki Corporation, Tokyo, Japan

[21] Appl. No.: 09/072,049

[22] Filed: May 5, 1998

[30] Foreign Application Priority Data

May 8, 1997 [JP] Japan ..... P 9-118423

[51] Int. Cl.[6] ..... H01R 13/40

[52] U.S. Cl. ..... 439/595

[58] Field of Search ..... 439/595, 744

[56] References Cited

U.S. PATENT DOCUMENTS 5,730,626 3/1998 Tomita et al. ..... 439/595
5,813,882 9/1998 Saito et al. ..... 439/595

FOREIGN PATENT DOCUMENTS 9-106846 4/1997 Japan .

*Primary Examiner*—Steven L. Stephan
*Assistant Examiner*—J. F. Duverne
*Attorney, Agent, or Firm*—Finnegan, Henderson, Farabow, Garrett & Dunner, L.L.P.

[57] ABSTRACT

A connector is provided with a housing, a front holder and a rib. The housing is fitable to an opposing connector. The housing includes a terminal receiving chamber where a terminal is received and an opposing surface to the opposing connector fitted with the housing. The front holder is disposed at a first position with respect to the housing by moving forward near to the opposing surface from above the opposing surface. The holder at the first position prevents the terminal from coming out from the terminal receiving chamber. The holder at the first position is movable backward away from the opposing surface by a jig operated from above the opposing surface. The rib projects from the housing and extends from the opposing surface. The rib guides the holder toward the first position and guides the jig toward the holder at the first position. Accordingly, the other parts such as the housing or the like are not injured by the jig, the jig can be easily and securely guided to the holder at the first position, and the holder can be easily taken out from the housing.

13 Claims, 6 Drawing Sheets

CONNECTOR WITH PROJECTED RIB TO GUIDE THE HOLDER AND THE JIG TO CONTROL THE CONNECTIVITY OF THE TERMINAL

BACKGROUND OF THE INVENTION

The present invention relates to a connector in which a front holder is engaged with a housing so that a terminal is prevented from coming out from an inner portion of a terminal receiving chamber.

FIGS. 1 and 2 show a connector 1 disclosed in Japanese Patent Unexamined Publication No. 9-106846. The connector 1 has a housing 3 and a front holder 5. In the housing 3, a terminal receiving chamber 2 for receiving a male terminal 7 is formed. The front holder 5 is inserted into an opposing surface 4 from above the opposing surface 4 to an opposing connector (not shown) within the housing 3, and prevents the male terminal 7 from coming out from the inner portion of the terminal receiving chamber 2.

In the housing 3, a hood portion 6 extending from an outer peripheral end of the opposing surface 4 and inserting the opposing connector is integrally formed. A connecting portion 8 of the male terminal 7 is projected within the hood portion 6. When the male terminal 7 is engaged with a flexible engaging arm 9 projected from an inner wall of the terminal receiving chamber 2, the male terminal 7 is prevented from coming out from the inner portion of the terminal receiving chamber 2. When the front holder 5 is inserted into the opposing surface 4 of the housing 3, a part of the front holder 5 is inserted into a space 10 allowing a deformation of the engaging arm 9, so that an elastic deformation of the engaging arm 9 is prevented. Accordingly, the male terminal 7 is doubly engaged within the terminal receiving chamber 2, so that the male terminal 7 is certainly prevented from coming out.

In the case of taking out the front holder 5 from the inner portion of the opposing surface 4 of the housing 3, that is, in the case of removing a double engagement of the male terminal 7 within the terminal receiving chamber 2, a removing jig 12 is inserted from an opening portion 11 for inserting the removing jig formed in the front holder 5, a front end of the removing jig 12 is hooked to the front holder 5 and the front holder 5 is drawn. Accordingly, the front holder 5 is drawn out from the housing 3.

However, in the conventional connector 1 mentioned above, at a time of inserting the front end portion of the removing jig 12 into the hood portion 6 in order to insert the removing jig 12 into the opening portion 11, the front end portion of the removing jig 12 may be erroneously brought into contact with the inner peripheral surface of the hood portion 6. When the removing jig 12 is moved toward the opening portion 11 with bringing the front end portion of the removing jig 12 into contact with the inner peripheral surface of the hood portion 6, there is a risk of injuring the inner peripheral surface of the hood portion 6 by the front end portion of the removing jig 12.

When the inner peripheral surface of the hood portion 6 is injured, there is a risk of deteriorating a sealing performance at a time of fitting to the opposing connector attaching a water preventing member.

Accordingly, at a time of taking out the front holder 5 by the removing jig 12, it is necessary to carefully perform in such a manner as not to bring the front end portion of the removing jig 12 into contact with the inner peripheral surface of the hood portion 6 or the sealing member, so that the removing operation is very troublesome.

SUMMARY OF THE INVENTION

Accordingly, an object of the present invention is to provide a connector which can easily and certainly guide a removing jig to a housing within a front holder and can easily remove the front holder from the housing.

In order to achieve the object mentioned above, in accordance with the present invention, there is provided a connector comprising:

In accordance with the connector structured in the above manner, while the holder moves forward from above the opposing surface to be disposed at the first position, the holder is guided by the rib.

On the other hand, when the holder is removed from the first position, the jig is guided to the holder at the first position by the rib and is operated from above the opposing surface. At this time, since moving range of the jig is restricted by the rig, the jig is prevented from being brought into contact with the other portion such as the housing or the like.

Accordingly, the other portions such as the housing or the like are not injured by the jig, so that the jig is easily and certainly guided to the holder at the first position, thereby easily removing the holder from the housing.

DESCRIPTION OF THE PREFERRED EMBODIMENTS

Figure 1:
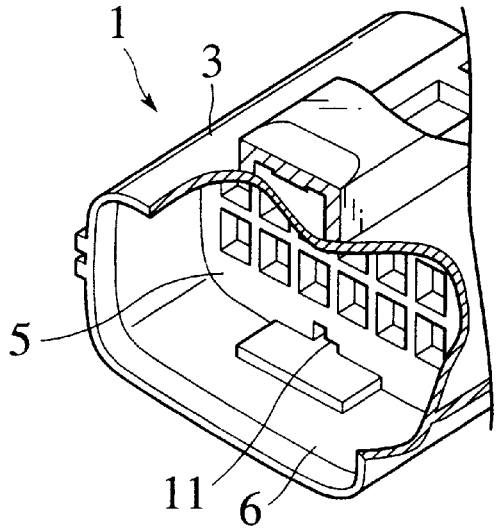
FIG.1 PRIOR ART
FIG. 1 is a perspective view which shows a conventional connector.
Figure 2:
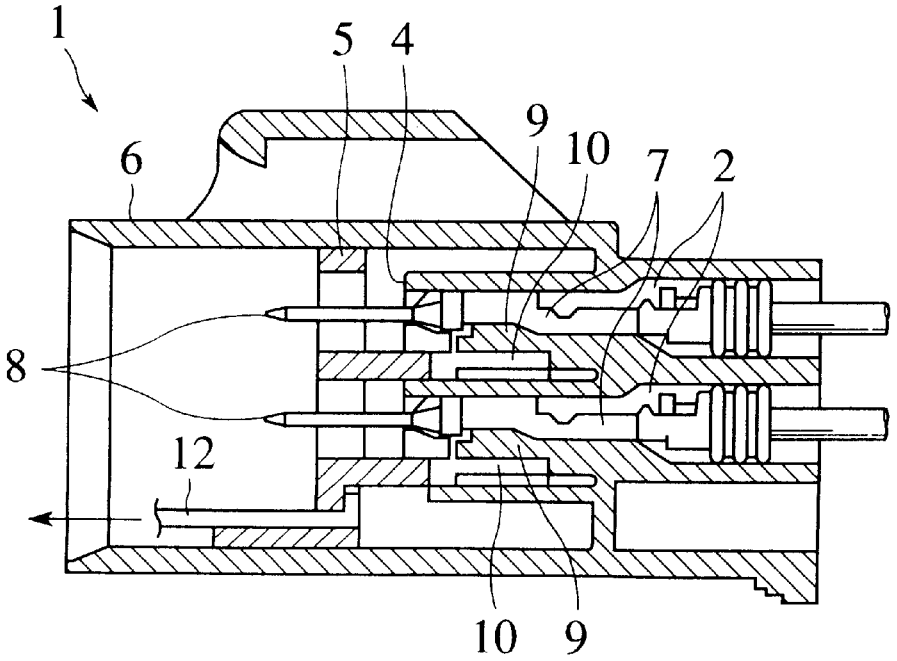
FIG.2 PRIOR ART
FIG. 2 is a cross sectional view of a conventional connector which shows a state of taking out a front holder from an inner portion of an opposing surface.
Figure 3:
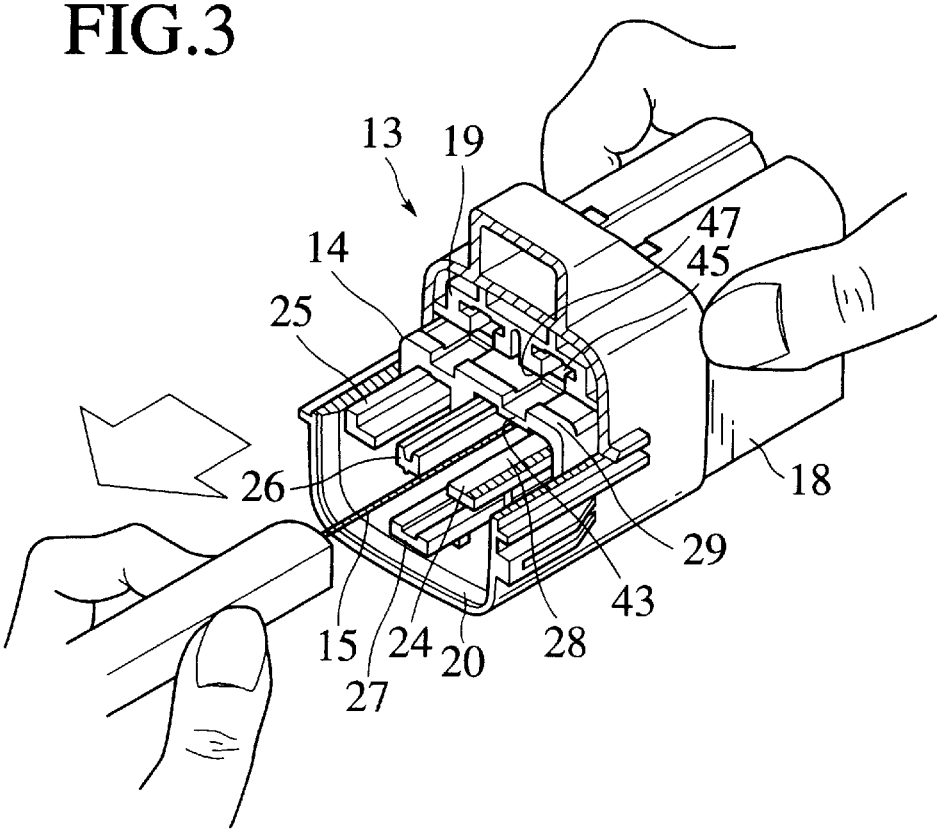
FIG. 3 is a perspective view showing an inner portion of a connector in accordance with an embodiment of the present invention in a partly broken manner which shows a state of taking out a front holder form a first position.
Figure 4:
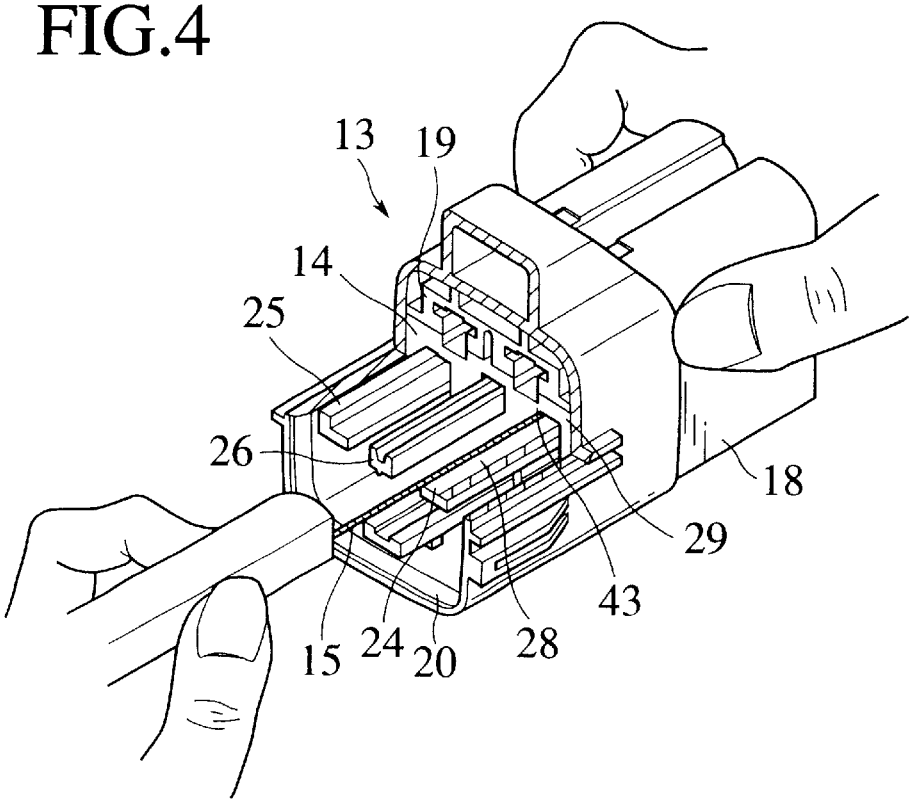
FIG. 4 is a perspective view showing an inner portion of the connector shown in FIG. 3 in a partly broken manner which shows a state of inserting a removing jig in order to take out the front holder form the first position.
Figure 5:
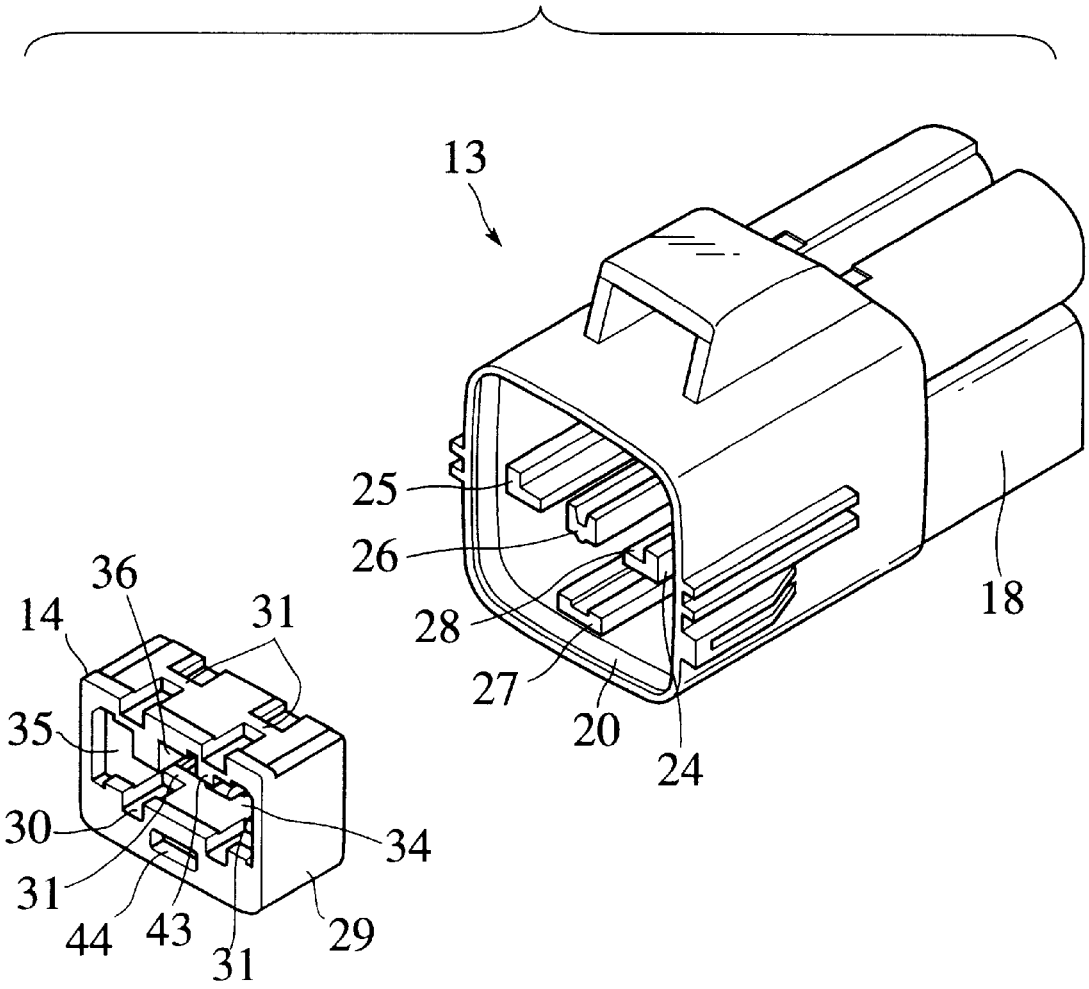
FIG. 5 is a exploded perspective view which shows a housing and a front holder of the connector shown in FIG. 3.

An embodiment of a connector in accordance with the present invention will be described below with reference to the drawings. FIG. 3 is a partly broken perspective view which shows an inner portion of a connector 13 in accordance with this embodiment at a time of taking out a front holder 14 from the inner portion of the connector 13, and FIG. 4 is a perspective view which shows a state of inserting a removing jig 15 in order to take out the front holder 14 from the connector 13. Further, FIG. 5 is an exploded perspective view which shows the connector 13 and the front holder 14 attached to the connector 13. In this case, in the following description, among movements of the front holder 14, a movement toward an opposing surface 19 is set to be a forward movement and a movement apart from the opposing surface 19 is set to be a backward movement.

As shown in FIGS. 3 to 5, the connector 13 has a housing 18 fitted to an opposing connector (not shown), the front holder 14 for fixing a terminal detachably held to the housing 18, a rib 24 integrally provided in the housing 18 and three auxiliary ribs 25, 26 and 27.

The housing 13 includes a plurality of terminal receiving chambers 17 (refer to FIGS. 8 and 9) receiving terminals 16, an opposing surface 19 to the opposing connector fitted to the housing 13, a holder receiving portion 45 and a waterproof hood portion 20 extending from a peripheral edge of the opposing surface 19. The holder receiving portion 45 has an opening 47 to the opposing surface 19. The hood portion 20 defines a space above the opposing surface 19 of the front holder 14, and gives an influence to a moving operation of the front holder 19 and an operation of the removing jig 15 from above the opposing surface 19 mentioned below.

When the front holder 14 moves toward near to the opposing surface 19 from above the opposing surface 19, the front holder 14 is inserted into the holder receiving portion 45 from the opening 47 and is disposed at a regular engaging position (a first position). The front holder 14 at the regular engaging position prevents the terminal 16 from coming out from the terminal receiving chamber 17.

The rib 24 and the auxiliary ribs 25, 26 and 27 project from a bottom surface 49 (refer to FIG. 8) opposing to the opening 47 of the holder receiving chamber 45, and extend within the hood portion 20. The rib 24 and the auxiliary rib 25 have a cross section formed substantially in an L shape, and the auxiliary ribs 26 and 27 have a cross section formed substantially in a U shape. The rib 24 and the auxiliary ribs 25, 26 and 27 are substantially in parallel with each other and extend substantially in a perpendicular manner to the opposing surface 19. The auxiliary rib 26 is disposed substantially in a center of the hood portion 20. The rib 24 and the auxiliary rib 25 are positioned on a plane passing through the center auxiliary rib 26, and the center auxiliary rib 26 is positioned between the rib 24 and the auxiliary rib 25. The auxiliary rib 27 is positioned on the other plane passing through the center auxiliary rib 26 and substantially perpendicular to the plane mentioned above. The rib 24 and the auxiliary ribs 25, 26 and 27 guides the front holder 14 toward a regular engaging position within the housing 18. An inner upper surface of the rib 24 guides the removing jig 15 for removing the front holder 14 toward the front holder 14 at the regular engaging position.

Figure 8:
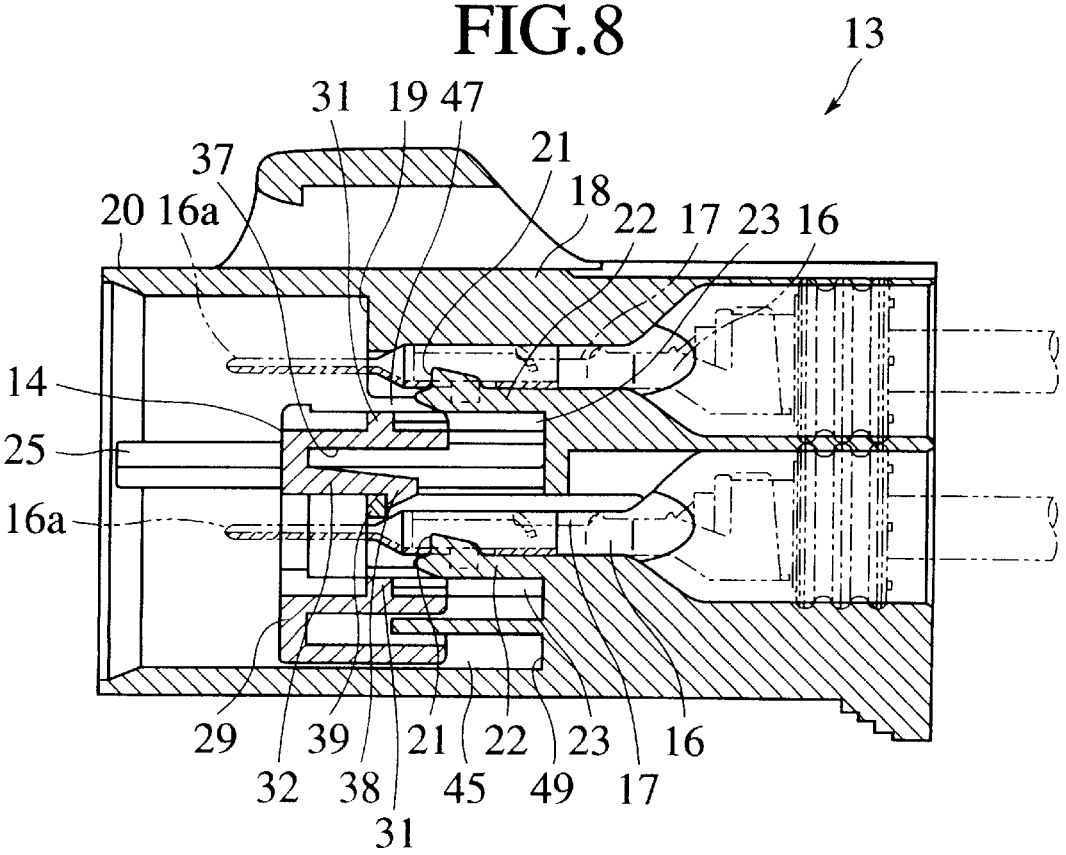
FIG. 8 is a cross sectional view which shows a relation between a temporary engaging arm and a temporary engaging portion when a front holder is disposed at a temporary engaging position, and corresponds to a cross sectional view along a line VIII—VIII in FIG. 6.
Figure 9:
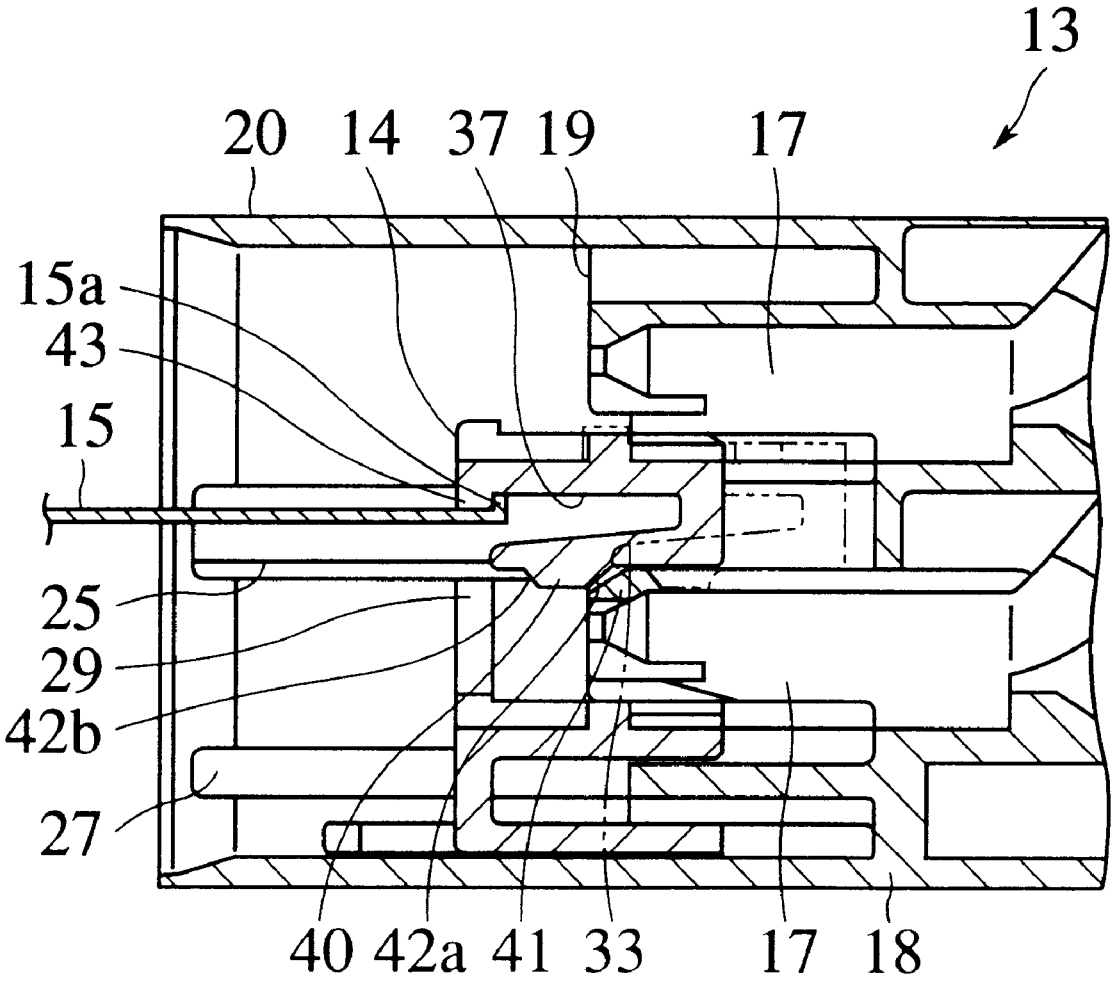
FIG. 9 is a cross sectional view which shows a relation between a regular engaging arm and a regular engaging portion when a front holder is disposed at a temporary engaging position, and corresponds to a cross sectional view along a line IX—IX in FIG. 6.

As shown in FIGS. 8 and 9, the terminal 16 has a connecting portion 16*a* electrically connected with an opposing terminal in the front end thereof. The connecting portion 16*a* projects within the hood portion 20 when the terminal 16 is received in the terminal receiving chamber 17.

The housing 18 is provided with a flexible engaging arm 22 projecting from the bottom surface 49 of the holder receiving portion 45andfacingtotheterminalreceiv-ingchamber17. The engaging arm 22 is positioned between the terminal receiving chamber 17 and the holder receiving portion 45. The engaging arm 22 has a terminal holding projection 21 engaging with the terminal 16 received within the terminal receiving chamber 17 in the front end thereof. When the terminal holding projection 21 of the engaging arm 22 engages with the terminal 16, the terminal 16 is prevented from coming out from the inner portion of the terminal receiving chamber 17. Among the holder receiving portion 45, a portion positioned in opposite to the terminal holding projection 21 serves as a space 23 allowing the engaging arm 22 to elastically deform.

Figure 6:
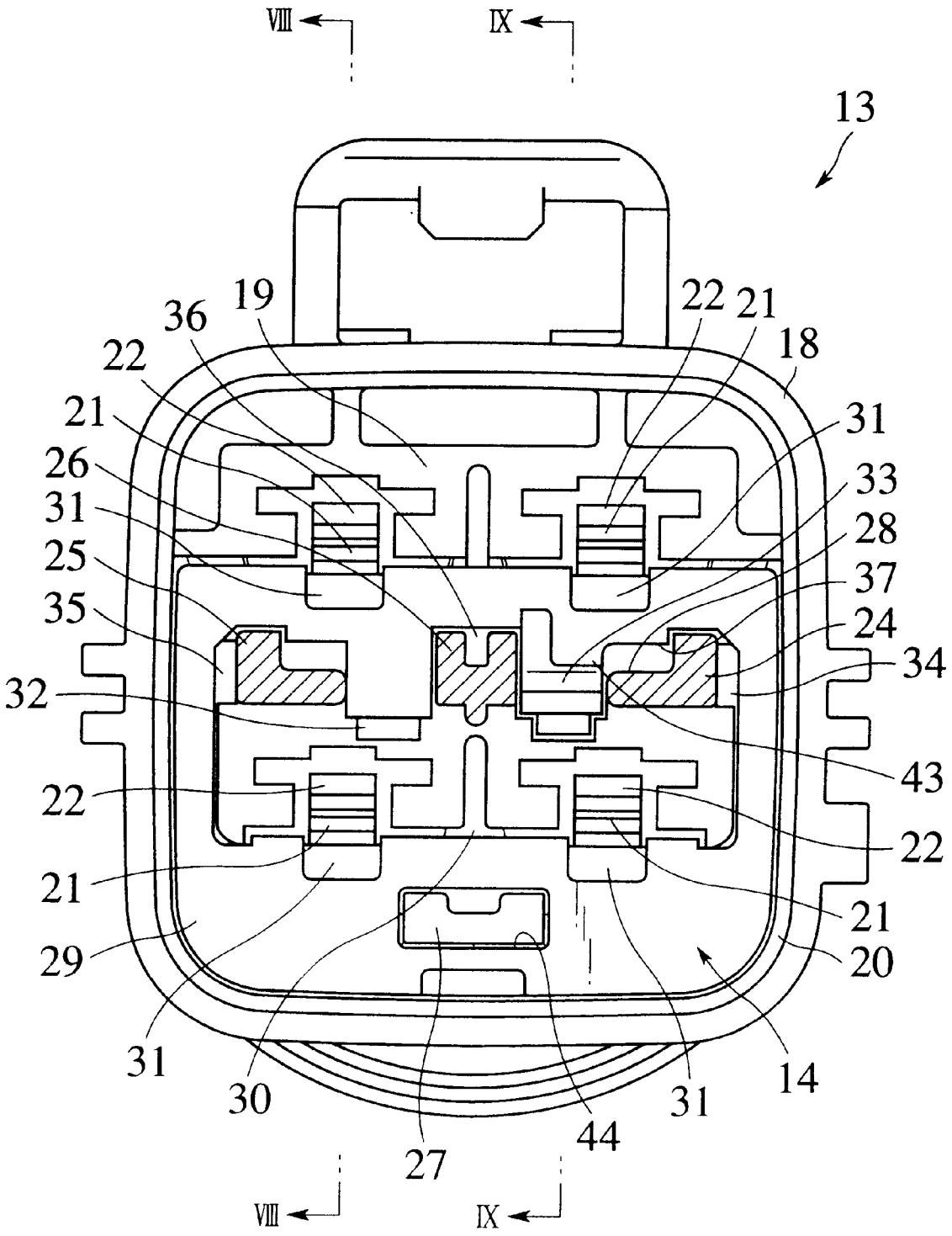
FIG. 6 is a front elevational view which shows a state of assembling the front holder shown in FIG. 5 to the housing.
Figure 7:
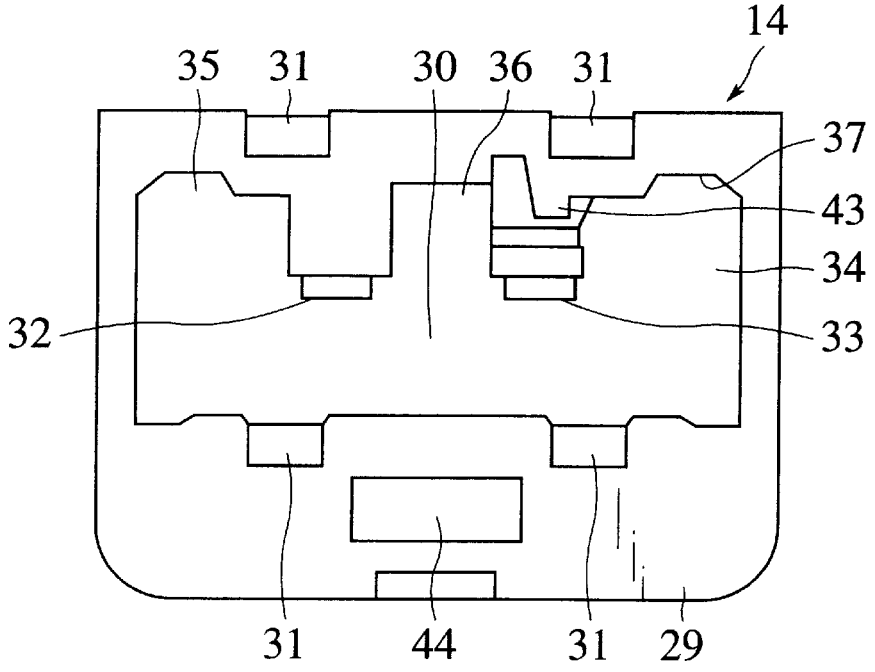
FIG. 7 is a front elevational view which shows a front holder shown in FIG. 5.

As shown in FIGS. 5 and 6, the front holder 14 is provided with a rectangular parallelepiped main body 29, rib insertion holes 30 and 44 extending through the main body 29 and deformation restricting portions 31 and 31 (refer to FIGS. 8 and 9). The deformation restricting portion 31 is inserted into the deformation allowing space 23 as the front holder 14 moves forward to the regular engaging position and restricts the deformation of the engaging arm 22. As shown in FIG. 7, a temporary engaging arm (a second arm) 32 supporting the front holder 14 at a temporary engaging position (a second position) with respect to the housing 18 and a regular engaging arm (a first arm) 33 supporting the front holder 14 at a regular engaging position are provided on the inner surface of the rib insertion hole 30.

The rib insertion hole 30 has rib insertion portions 34 and 35 inserting the rib 24 and the auxiliary rib 25 in both side portions, and has a center rib insertion portion 36 inserting the center auxiliary rib 26 in the center portion. The deformation restricting portion 31 is inserted into the deformation allowing space 23 as the front holder 14 moves forward. When the front holder 14 is disposed at the regular engaging position, the deformation restricting portion 31 is inserted into the deformation allowing space 23, so that the deformation of the engaging arm 22 is prevented. When the front holder 14 is disposed at the temporary engaging position, the deformation restricting portion 31 comes out from the deformation allowing space 23, so that the deformation of the engaging arm is allowed.

As shown in FIGS. 7 and 8, the temporary engaging arm 32 is projected from the inner surface 37 of the rib insertion hole 30 toward in a direction that the front holder 14 moves forward. A hook portion 38 engageable with a temporary engaging portion (a second engaging portion) 39 provided on the housing 18 is provided in the front end portion of the temporary engaging arm 32. The front holder 14 is supported at the temporary engaging position with respect to the housing 18 by an engagement between the hook portion 38 and the temporary engaging portion 39, thereby preventing the front holder 14 from coming out from the housing 18. In this state, as mentioned above, the deformation restricting portion 31 is out from the deformation allowing space 23.

As shown in FIGS. 7 and 9, the regular engaging arm 33 is projected from the inner surface 37 of the rib insertion hole 30 toward in a direction that the front holder 14 moves backward, and is adjacent to the temporary engaging arm 32. A protrusion portion 40 engageable with a regular engaging portion (a first engaging portion) 41 provided on the housing 18 is projected in the front end portion of the regular engaging arm 33. The front holder 14 is supported at the regular engaging position with respect to the housing 18 by an engagement between the protrusion 40 and the regular engaging portion 41 (refer to a two-dot chain line in FIG. 9). In this state, as mentioned above, the deformation restricting portion 31 is inserted into the deformation allowing space 23.

Inclined surfaces 42*a* and 42*b* are formed in both sides of the protrusion 40. When the front holder 14 at the temporary engaging position is pressed toward the opposing surface 19, the regular engaging arm 33 is bent so that one inclined surface 42*a* rides over the regular engaging portion 41 and the front holder 14 moves forward to the regular engaging position. Further, in a state that the front holder 14 is disposed at the regular engaging position (refer to a two-dot chain line in FIG. 9), the other inclined surface 42*b* is brought into contact with the regular engaging portion 41, and the front holder 14 is held at the regular engaging position. When the front holder 14 at the regular engaging position is drawn by the removing jig 15 so as to be moved backward, the regular engaging arm 33 is bent, the other inclined surface 42*b* rides over the regular engaging portion 41 and the front holder 14 is moved backward to the temporary engaging position. A further backward movement of the front holder 14 from the temporary engaging position is restricted by an engagement between the temporary engaging portion 39 and the hook portion 38.

In the inner surface 37 of the rib insertion hole 30, an engagement removing projection 43 is projected to a portion between the regular engaging arm 33 and the rib insertion portion 34. The front end portion 15a of the removing jig 15 is engaged with the engagement removing projection 43. Further, the engagement removing projection 43 corresponds to the removing jig guiding portion 28 on the upper surface inside the rib 24, and is structured such as to easily engage the front end portion 15*a* of the removing jig 15 guided by the rib 24 to the engagement removing projection 43.

In the case of mounting the front holder 14 to the housing 18, as shown in FIG. 3, the front ends of the rib 24 and the auxiliary ribs 25, 26 and 27 are respectively inserted into the rib insertion portions 34, 35, 36 and 44 of the front holder 14. In this state, as shown in FIG. 4, the front holder 14 is moved forward toward the opposing surface 19. At this time, the rib 24 and the auxiliary ribs 25, 26 and 27 precisely guide the front holder 14 toward the temporary engaging position and the regular engaging position.

Particularly, since a plurality of auxiliary ribs 25, 26 and 27 are provided, the front holder 14 moves with respect to the opposing surface 19 substantially in a parallel state. For this reason, the pressing force is applied to the front holder 14 substantially in an even manner.

When the front holder 14 is pressed and moved forward, as shown in FIG. 8, the temporary engaging arm 32 is elastically deformed, and the hook portion 38 rides over and is engaged with the temporary engaging portion 39. In this state, the front holder 14 is substantially half inserted into the holder receiving portion 45 and then reaches the temporary engaging position. At this time, as shown in FIG. 9, the one inclined surface 42*a* of the protrusion 40 in the regular engaging arm 33 is brought into contact with the regular engaging portion 41. For this reason, the front holder 14 is moved forward without affected by the hood portion 20, and is supported to the housing 18 at the temporary engaging position. Further, in this state, the deformation restricting portion 31 of the front holder 14 is not inserted into the deformation allowing space 23.

When the front holder 14 at the temporary engaging position is further pressed forward, the regular engaging arm 33 is elastically deformed, the inclined surface 42*a* rides over the regular engaging portion 41, and the inclined surface 42*b* is engaged with the regular engaging portion 41. In this state, the front holder 14 is sufficiently inserted into the holder receiving portion 45 and is supported to the housing 18 at the regular engaging position. Further, in this state, the deformation restricting portion 31 is inserted into the deformation allowing space 23, and the deformation of the engaging arm 22 is restricted. Accordingly, the terminal 16 is received within the terminal receiving chamber 17 in a state of being doubly engaged. Still further, in this state, the hook portion 38 of the temporary engaging arm 32 is apart from the temporary engaging portion 39.

In the case of backward moving the front holder 14 to the temporary engaging position from the regular engaging position, the front end portion 15*a* of the removing jig 15 is inserted into the hood portion 20 with being brought into contact with the upper surface inside the rib 24. Accordingly, the front end portion 15*a* of the removing jig 15 is guided to the lower portion of the engagement removing projection 43 in the front holder 14 by the rib 24 without affected by the hood portion 20, and in this state, the front end portion 15*a* of the removing jig 15 is engaged with the engagement removing projection 43.

Then, by drawing the removing jig 15, the front holder 14 is moved to the temporary engaging position from the regular engaging position. At this time, the inclined surface 42*b* of the regular engaging arm 33 rides over the regular engaging portion 41, so that a supporting state at the regular engaging position is removed. Further, when the front holder 14 is moved by the removing jig 15, the hook portion 38 of the temporary engaging arm 32 is engaged with the temporary engaging portion 39, and the front holder 14 is supported at the temporary engaging position.

In accordance with the connector 13 of this embodiment, by providing the rib 24 guiding the front holder 14 toward the regular engaging position, the front holder 14 is prevented from inclining and coming down within the hood portion 20 at a time of forward and backward movement of the front holder 14, so that the front holder 14 can easily move without affected by the hood portion 20.

Further, the front holder 14 moves substantially in parallel to the opposing surface 19 by a plurality of auxiliary ribs 25, 26 and 27. For this reason, balanced pressing force to the front holder 14 and balanced drawing force by the removing jig 15 are evenly applied to the front holder 14, so that the front holder 14 can be further securely prevented from inclining and coming down within the hood portion 20.

Still further, by providing the removing jig guiding portion 28 for guiding the front end portion 15*a* of the removing jig 15 to the engagement removing position (the lower portion of the engagement removing projection 43) in the rib 24, at a time of engaging the front end portion 15*a* of the removing jig 15 with the engagement removing projection 43 of the front holder 14, the front end portion of the removing jig 15 is not slid on the inner peripheral surface of the hood portion 20, thereby not injuring the seal member (not shown) provided in the inner peripheral surface of the hood portion 20 or the housing 18.

What is claimed is:

1. A connector comprising:

a housing fitting to an opposing connector, the housing including a terminal receiving chamber receiving a terminal and an opposing surface to the opposing connector fitted to the housing;

a holder disposed at a first position with respect to the housing by moving forward near to opposing surface from above the opposing surface, the holder at the first position preventing the terminal from coming out from the terminal receiving chamber, and the holder at the first position being movable backward away from the opposing surface by a jig operated from above the opposing surface; and a rib projecting from the housing and extending in a direction away from the opposing surface, the rib guiding the holder toward the first position and guiding the jig toward the holder at the first position.

2. A connector as recited in claim 1, wherein the housing includes a flexible engaging arm projecting within the terminal receiving chamber and a space portion allowing the engaging arm to be elastically deformed, the engaging arm engages with the terminal inserted into the terminal receiving chamber and restricts the terminal from coming out from the terminal receiving chamber, and the holder at the first position restricts the elastic deformation of the engaging arm.

3. A connector as recited in claim 1, wherein the housing has a first engaging portion, the holder has a first holding portion engaged with the first engaging portion when the holder is disposed at the first position, and the holder is held at the first portion by an engagement between the first engaging portion and first holding portion.

4. A connector as recited in claim 2, wherein the housing has first and second engaging portions, the holder has a deformation restricting portion, a first holding portion and a second holding portion, the deformation restricting portion is inserted into the space as the holder moves forward, so as to restrict the engaging arm from being elastically deformed, the first holding portion engages with the first engaging portion when the holder is disposed at the first position, the holder is held at the first portion by an engagement between the first engaging portion and the first holding portion, and the second holding portion engages with the second engaging portion when the holder moves backward from the first position to a second position where the deformation restricting portion is out of the space, the holder is held at the second portion by an engagement between the second engaging portion and the second holding portion.

5. A connector as recited in claim 2, wherein the housing has first and second engaging portions, the holder has a main body, an insertion portion extending through the main body, a deformation restricting portion provided in the main body and first and second flexible arms projecting from an inner surface defining the insertion portion, the holder is guided toward the first position by the rib when the holder moves forward as the rib is inserted into the insertion portion, the deformation restricting portion is inserted into the space as the holder moves forward, so as to restrict the engaging arm from being elastically deformed, the first arm engages with the first engaging portion when the holder is disposed at the first position, so as to restrict the holder from moving backward, and the second arm engages with the second engaging portion when the holder moves backward moves from the first position to a second position where the deformation restricting portion is out of the space, so as to restrict the holder from further moving backward from the second position.

6. A connector as recited in claim 5, wherein the first arm engages with the first engaging portion when the holder is disposed at the second position, so as to restrict the holder from moving forward from the second position.

7. A connector as recited in claim 1, wherein the holder has a projection engageable with the jig on the inner surface of the insertion portion, and the rib guides the jig to the projection of the holder at the first position.

8. A connector as recited in claim 1, wherein the rib has an L-shaped cross section, and the jig is guided along an upper surface inside the rib.

9. A connector as recited in claim 1, wherein the housing has defining portion defining a space above the opposing surface and affecting a moving operation of the holder.

10. A connector as recited in claim 9, wherein the defining portion is a hood extending from an outer peripheral edge of the opposing surface, and the opposing connector is inserted into the hood so as to be fitted into the housing.

11. A connector as recited in claim 5, wherein the housing has two auxiliary ribs substantially in parallel to the rib, the auxiliary rib projects from the housing and extends in the direction away from the opposing surface, the holder has two auxiliary insertion portions extending through the main body, and the holder is guided toward the first position by the rib and the auxiliary rib when the holder as the rib is inserted into the insertion portion and the auxiliary rib is inserted into the auxiliary insertion portion moves forward.

12. A connector as recited in claim 1, wherein the housing has a holder receiving portion where an opening to the opposing surface is included and the holder is inserted from the opening, at least a part of the holder at the first position is inserted into the holder receiving portion from the opening, and the rib projects from an inner surface defining the holder receiving portion.

13. A connector as recited in claim 12, wherein the holder at the first position is sufficiently inserted in the holder receiving portion.

* * * * *